US011337463B2

(12) United States Patent
Antonopoulos et al.

(10) Patent No.: US 11,337,463 B2
(45) Date of Patent: May 24, 2022

(54) AEROSOL-GENERATING SYSTEM WITH CASE

(71) Applicant: Philip Morris Products S.A., Neuchatel (CH)

(72) Inventors: Roland Antonopoulos, Neuchatel (CH); Jean-Luc Fringeli, Singapore (SG)

(73) Assignee: Philip Morris Products S.A., Neuchatel (CH)

( * ) Notice: Subject to any disclaimer, the term of this patent is extended or adjusted under 35 U.S.C. 154(b) by 104 days.

(21) Appl. No.: 16/606,116

(22) PCT Filed: May 2, 2018

(86) PCT No.: PCT/EP2018/061234
§ 371 (c)(1),
(2) Date: Oct. 17, 2019

(87) PCT Pub. No.: WO2018/202732
PCT Pub. Date: Nov. 8, 2018

(65) Prior Publication Data

US 2021/0282467 A1 Sep. 16, 2021

(30) Foreign Application Priority Data

May 2, 2017 (EP) ..... 17169141

(51) Int. Cl.
*A24F 13/00* (2006.01)
*A24F 40/95* (2020.01)
(Continued)

(52) U.S. Cl.
CPC ..... *A24F 40/95* (2020.01); *A24F 40/20* (2020.01); *A24F 40/40* (2020.01); *H01R 13/2407* (2013.01); *H01R 13/2471* (2013.01)

(58) Field of Classification Search
CPC ..... A24F 47/00
(Continued)

(56) References Cited

U.S. PATENT DOCUMENTS

2009/0095311 A1 4/2009 Han
2013/0037042 A1 2/2013 Hearn et al.
(Continued)

FOREIGN PATENT DOCUMENTS

CN 105792690 A 7/2016
CN 105934169 A 9/2016
(Continued)

OTHER PUBLICATIONS

International Search Report and Written Opinion dated Aug. 8, 2018 in PCT/EP2018/061234 filed May 2, 2018.
(Continued)

*Primary Examiner* — Phuong K Dinh
(74) *Attorney, Agent, or Firm* — Oblon, McClelland, Maier & Neustadt, L.L.P.

(57) ABSTRACT

An electrically operated aerosol-generating system is provided, including an aerosol-generating device and a case configured to receive the aerosol-generating device. The case includes a housing having an opening and a device holder pivotally coupled to the housing and pivotable relative to the housing between an open position and a closed position. The device holder includes an external wall and one or more internal walls arranged to releasably hold the aerosol-generating device. The device holder has a first end and a second end, opposite the first end, and the device holder is pivotally coupled to the housing at or around the first end.

15 Claims, 6 Drawing Sheets

(51) Int. Cl.
*A24F 40/40* (2020.01)
*A24F 40/20* (2020.01)
*H01R 13/24* (2006.01)

(58) Field of Classification Search
USPC ..... 131/328–329
See application file for complete search history.

(56) References Cited

U.S. PATENT DOCUMENTS

| | | | | |
|---|---|---|---|---|
| 2015/0013696 | A1 | 1/2015 | Plojoux et al. | |
| 2015/0020832 | A1 | 1/2015 | Greim et al. | |
| 2015/0034507 | A1 | 2/2015 | Liu | |
| 2015/0245663 | A1 | 9/2015 | Memari et al. | |
| 2016/0050975 | A1 | 2/2016 | Worm et al. | |
| 2016/0150824 | A1 | 6/2016 | Memari et al. | |
| 2016/0345629 | A1 | 12/2016 | Mironov | |
| 2016/0353801 | A1 | 12/2016 | Zinovik et al. | |
| 2016/0366946 | A1 | 12/2016 | Murison et al. | |
| 2017/0045994 | A1 | 2/2017 | Murison et al. | |
| 2020/0022416 | A1* | 1/2020 | Alarcon | G16H 40/63 |
| 2021/0178090 | A1* | 6/2021 | Lahoud | A24F 40/10 |

FOREIGN PATENT DOCUMENTS

| | | | |
|---|---|---|---|
| CN | 106572708 | A | 4/2017 |
| EP | 3 180 060 | B1 | 6/2017 |
| JP | 2013-150593 | | 8/2013 |
| RU | 2617297 | C2 | 4/2017 |
| UA | 41898 | C2 | 10/2001 |
| WO | WO2016/074230 | A1 | 5/2016 |

OTHER PUBLICATIONS

Combined Russian Notice of Allowance and Search Report dated Sep. 22, 2021 in corresponding Russian Patent Application No. 2019136701 (with English translation), 20 pages.

Office Action dated Oct. 7, 2021 in Taiwanese Application No. 107114054 (with Computer Generated English Translation.

Office Action dated Oct. 25. 2021 in Indian Application No. 201917040462.

Combined Chinese Office Action and Search Report dated Feb. 10, 2022 in corresponding Chinese Patent Application No. 201880025304.X (with English translation), 12 pages.

* cited by examiner

AEROSOL-GENERATING SYSTEM WITH CASE

CROSS-REFERENCE TO RELATED APPLICATIONS

This application is a U.S. national stage application of PCT/EP2018/061234, filed on May 2, 2018, which is based upon and claims the benefit of priority from European patent application no. 17169141.3, filed May 2, 2017, the entire contents of each of which are incorporated herein by reference.

TECHNICAL FIELD

The present invention relates to electrically operated aerosol-generating systems and particularly to electrically operated aerosol-generating systems having aerosol-generating devices and cases for receiving aerosol-generating devices.

DESCRIPTION OF THE RELATED ART

Electrically operated aerosol-generating systems generally comprise an aerosol-forming substrate and an atomiser, which is operated to atomise volatile compounds in the aerosol-forming substrate to form an aerosol for inhalation by a user. Typically, electrically operated aerosol-generating systems also comprise an aerosol-generating device comprising an electrical power supply for supplying power to the atomiser. The atomiser may be an electric heater.

In some systems, the aerosol-generating device is configured to receive an aerosol-generating article comprising a solid aerosol-forming substrate, such as a gathered, crimped sheet of tobacco. In these systems, the device typically comprises the atomiser, which is arranged to heat the aerosol-forming substrate when the article is received in the device. The article may also comprise a filter, which is wrapped together with the aerosol-forming substrate in the form of a rod, similar to a conventional cigarette. In other systems, the device is configured to receive a cartridge comprising the atomiser and a liquid aerosol-forming substrate. Such cartridges are often referred to as cartomisers. Common types of atomiser used in cartomisers comprises a coil of heater wire wound around an elongate wick soaked in liquid aerosol-forming substrate.

Some electrically operated aerosol-generating systems comprise a case for releasably holding the aerosol-generating device when not in use. Such cases may provide a degree of protection for the aerosol-generating device and may also provide additional functions such as recharging and refilling with aerosol-forming substrate.

Cases for holding aerosol-generating devices often comprise housings defining narrow openings into which a user is required to insert the device. The narrow openings typically have a width similar to the width of the aerosol-generating device. Users inserting an aerosol-generating device into these cases are generally required to closely align the aerosol-generating device with the narrow opening to insert the device into the case. This can be difficult for users, especially in low light or when the user is moving.

It would be desirable to provide a case for an aerosol-generating device which improves the speed and ease with which a user is able to insert the aerosol-generating device into the case and remove the aerosol-generating device from the case. It would also be desirable to provide a case that enables straightforward and reliable engagement between an electrical connector part of an aerosol-generating device with an electrical connector part of a case, when the device is received in the case.

SUMMARY

According to an aspect of the invention there is provided an electrically operated aerosol-generating system comprising an aerosol-generating and a case configured to receive the aerosol-generating device. The aerosol-generating device comprises: a proximal end; a distal end opposite the proximal end, the distal end having a distal end face; a first rechargeable electrical power supply; and a cavity for receiving an aerosol-forming substrate at the proximal end. The case comprises a housing having an opening and a device holder pivotally coupled to the housing and pivotable relative to the housing between an open position and a closed position. The device holder comprises an external wall and one or more internal walls arranged to releasably hold the aerosol-generating device. The device holder has a first end and a second end, opposite the first end. The device holder is pivotally coupled to the housing at or around the first end. The case further comprises a second rechargeable electrical power supply housed in the housing and arranged to supply power to the aerosol-generating device when the aerosol-generating device is received in the device holder and the device holder is in the closed position.

BRIEF DESCRIPTION OF THE DRAWINGS

The invention will be further described, by way of example only, with reference to the accompanying drawings in which.

DETAILED DESCRIPTION

Figure 1:
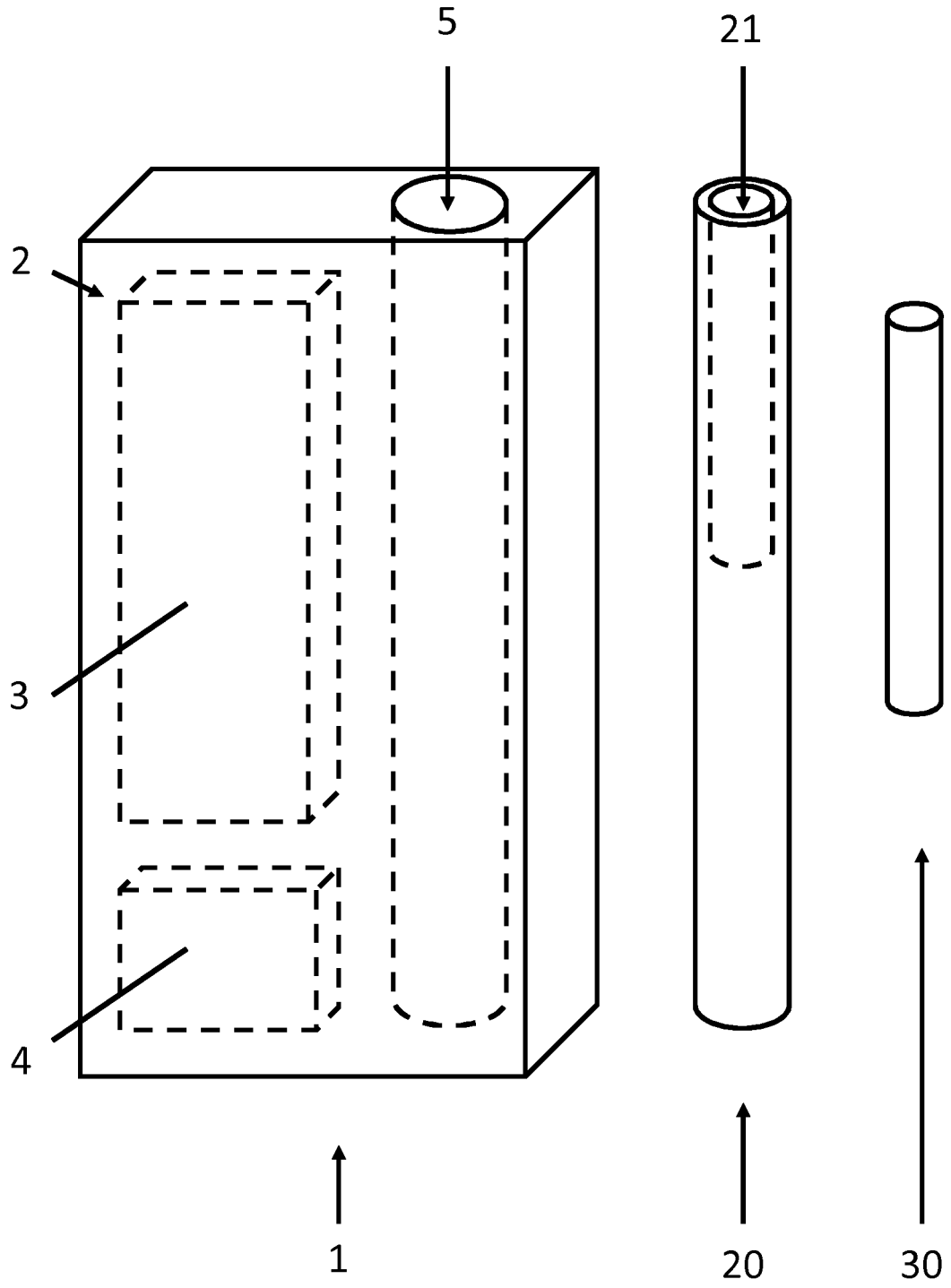
FIG. 1 shows a schematic illustration of a known electrically operated aerosol-generating system comprising an aerosol-generating article, an aerosol-generating device and a case for the electrically operated aerosol-generating article.

The system may further comprise an electrical connector comprising: a first connector part at the distal end face of the aerosol-generating device; and a second connector part in the housing or the device holder of the case at or around the first end of the device holder when the device holder is in the closed position. The first and second connector parts may be arranged to releasably electrically connect when the aerosol-generating device is received in the device holder and the device holder is in the closed position.

Providing the device with a first part of an electrical connector and the case with a second part of an electrical connector a connector enables the device to be electrically connected to the case when the first and second connector parts are engaged. This may enable at least one of power and data to be transferred between the case and the aerosol-generating device.

Providing an aerosol-generating device with an electrical connector part at a distal end face of the device may reduce the likelihood of fowling or damaging the electrical connector part of the device during normal use. Typically, aerosol-generating devices are elongate, comprising a proximal end at which there is a cavity for receiving an aerosol-forming substrate and, in some embodiments, a mouthpiece. Such devices may be held in the hand of a user in a similar manner to a conventional smoking article, such as a cigarette or a cigar. In other words, such aerosol-generating devices are typically held in the hand of a user between the proximal and distal ends and not at the proximal or distal end faces. As such, arranging the first connector part at a distal end face of the device reduces the likelihood of a user touching the first connector part during normal use.

In some embodiments, a portion of the device holder at or around the second end does not comprise the one or more internal walls.

Providing the case with a device holder for receiving the aerosol-generating device that is pivotally coupled to the housing at one end may enable the case to provide an opening for receiving the aerosol-generating device with a variable size. In particular, the pivotal coupling of the device holder to the housing may enable the opening for receiving the aerosol-generating device to be larger compared to cases comprising openings of a fixed size. This increased opening size may improve the speed and ease with which a user is able to insert the aerosol-generating device into the case and remove the aerosol-generating device from the case.

In some embodiments, a portion of the device holder of the present invention does not comprise the one or more internal walls at or around the second end. In other words, the one or more internal walls of the device holder do not extend in or over a portion of the device holder at or around the second end. This provides one or more spaces or gaps between the one or more internal walls and the external wall at or around the second end of the device holder in which the one or more internal walls are not provided. The spaces or gaps in the device holder are located at or around the second end of the device holder, which is opposite the end of the device holder comprising the pivotal coupling with the housing. As such, when the second end of the device holder is rotated or pivoted away from the housing into the open position, a user may be able to insert a portion of an end of the aerosol-generating device into the device holder through the one or more gaps, without fully aligning the aerosol-generating device with the device holder. The spaces or gaps at the second end of the device holder may enable a user to insert the aerosol-generating device into the device holder at a wider range of angles compared to a device holder having internal walls extending substantially to the second end of the device holder. This may facilitate insertion of the aerosol-generating device into the device holder.

In addition, the portion of the external wall at the portion of the device holder at the second end that does comprise the one or more internal walls may be used as a guide for aligning the aerosol-generating device with the device holder. This may further facilitate insertion of the aerosol-generating device into the device holder.

Spaces or gaps at the second end of the device holder, which may be provided by the portion at the second end that does not comprise the one or more internal walls, may also enable a user to access or grip an aerosol-generating device that is received or held in the device holder, when the device holder is in the open position. By facilitating removal of the aerosol-generating device from the case, the device holder may not be required to include a lifting mechanism for raising the aerosol-generating device out of the device holder. This may reduce the manufacturing cost and manufacturing complexity of the case compared to a case comprising a lifting mechanism for removing an aerosol-generating device from the case.

As used herein, the term 'open position' is used to describe angular or rotational positions or orientations of the device holder relative to the housing in which the aerosol-generating device may be received by the device holder and removed from the device holder. Similarly, as used herein the term 'closed position' is used to describe angular or rotational positions of the device holder relative to the housing in which the aerosol-generating device may be substantially prevented or inhibited from being received by the device holder and in which the aerosol-generating device may be substantially prevented or inhibited from being removed from the device holder.

As used herein, the term 'aerosol-generating device' refers to a device that interacts with an aerosol-forming substrate to generate an aerosol that is directly inhalable into a user's lungs thorough the user's mouth. In certain embodiments, an aerosol-generating device may heat an aerosol-forming substrate to facilitate the release of the volatile compounds. An aerosol-generating device may interact with an aerosol-generating article comprising an aerosol-forming substrate or a cartridge comprising an aerosol-forming substrate. An electrically operated aerosol-generating device may comprise an atomiser, such as an electric heater, to heat the aerosol-forming substrate to form an aerosol.

As used herein, the term 'aerosol-generating article' refers to an article comprising an aerosol-forming substrate capable of releasing volatile compounds, which can form an aerosol. In certain embodiments, the aerosol-generating article may comprise an aerosol-forming substrate capable of releasing upon heating volatile compounds, which can form an aerosol.

As used herein, the terms 'upstream', 'downstream', 'proximal' and 'distal' are used to describe the relative positions of components, or portions of components, of aerosol-generating devices, aerosol-generating articles and cases.

As used herein, the term 'longitudinal' is used to describe the direction between a downstream, proximal or mouth end and the opposed upstream or distal end and the term 'transverse' is used to describe the direction perpendicular to the longitudinal direction.

As used herein, the term 'length' is used to describe the maximum longitudinal dimension between the distal or upstream end and the proximal or downstream end of components, aerosol-generating devices, aerosol-generating articles and cases.

As used herein, the term 'diameter' is used to describe the maximum transverse dimension of components, aerosol-generating devices, aerosol-generating articles and cases.

As used herein, the term 'transverse cross-section' is used to describe the cross-section of components, aerosol-generating devices, aerosol-generating articles and cases in the direction perpendicular to the major axis of the components, aerosol-generating devices, aerosol-generating articles and cases, respectively.

The case of the present invention is configured to receive the aerosol-generating device. The case may have any suitable size and shape for receiving the aerosol-generating device. Typically, the case is portable. In other words, the case has a suitable size and shape to be carried by a user. The case may have a size and shape similar to a conventional packet of cigarettes. The case may have any suitable diameter and any suitable length. In some embodiments, the case may have a shape, diameter and length substantially similar to a conventional pack of cigarettes. The case may have a length between about 50 mm and about 200 mm. The case may have an external diameter between about 10 mm and about 50 mm.

The case may have a transverse cross-section of any suitable shape. For example, the case may have a substantially circular, elliptical, triangular, square, rhomboidal, trapezoidal, pentagonal, hexagonal or octagonal transverse cross-section. In some particular embodiments, the aerosol-generating device has a substantially rectangular transverse cross-section. The case may have a substantially constant transverse cross-section along its length. The case may have a substantially rectangular transverse cross-section along its length. In particular embodiments, the case may be a substantially rectangular cuboid.

The case comprises a housing and a device holder.

The housing may generally form the shape of the case. The housing may comprise one or more walls. In particular embodiments, the housing may be a substantially rectangular cuboid.

The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. In particular embodiments, the material is light and non-brittle.

The housing of the case comprises an opening. The opening may be any suitable size and shape. The opening may generally be sized and shaped to receive the device holder and the aerosol-generating device when the aerosol-generating device is received in the device holder. The opening may generally be sized and shaped to receive the one or more internal walls of the device holder and the aerosol-generating device. In some particular embodiments, the opening of the housing may extend substantially over one side of the housing. The case may generally form a rectangular box that is open at one side.

The housing may define a cavity or a space for receiving the device holder and an aerosol-generating device received in the device holder. The cavity or space may be an open cavity or space, such that the device holder and the aerosol-generating device may be inserted into the cavity or space through the opening of the housing. The cavity or space may be configured to receive the one or more internal walls of the device holder and an aerosol-generating device received in the device holder when the device holder is in the closed position. Typically, the cavity or space is configured to receive the entire aerosol-generating device when the device holder is in the closed position. Advantageously, this may enable the aerosol-generating device to be entirely enclosed within the cavity or space and may enable the case to protect the aerosol-generating device from the external environment.

The device holder is configured to receive the aerosol-generating device. The device holder may be a drawer or a cradle that is sized to hold or contain the aerosol-generating device. The device holder comprises an external wall and one or more internal walls. The external wall and the one or more internal walls are arranged to releasably hold the aerosol-generating device. In some embodiments, the one or more internal walls are attached or joined to the external wall. In other embodiments, the one or more internal walls are integrally formed with the external wall. The device holder may be formed from any suitable material. Typically, the device holder is formed from the same material as the housing of the case. The external wall may and the one or more internal walls may be formed from the same material. The external wall and the one or more internal walls may be made from different materials.

The device holder may be any suitable size and shape for receiving the aerosol-generating device.

The external wall and the one or more internal walls may be configured and arranged in any suitable configuration and arrangement to releasably hold the aerosol-generating device. The external wall and the one or more internal walls may be arranged to define a passage or a channel for receiving the aerosol-generating device. The passage or channel may have any suitable size and shape. Typically, the passage or channel may have a substantially similar size and shape to the aerosol-generating device. The passage or channel may have any suitable transverse cross-section. For example, the passage or channel may have a substantially circular, elliptical, triangular, square, rhomboidal, trapezoidal, pentagonal, hexagonal or octagonal transverse cross-section. Typically, the transverse cross-section of the passage or channel is substantially circular. The passage or channel may have any suitable length. Typically the length of the passage or channel is less than the length of the aerosol-generating device. The transverse cross-section of the passage or channel may be substantially similar along the length of the passage or channel.

The passage or channel may be open at one end. The passage or channel may be open at one end and closed at the other end, opposite the open end. The passage or channel may be open at both ends. Where the passage or channel comprises a closed end, the closed end may be arranged at or around the first end of the device holder.

In some embodiments, the external wall and the one or more internal walls may be arranged to form a tube comprising the passage or the channel.

The external wall has a length and the one or more internal walls each have a length. Typically, the length of the external wall defines the length of the device holder. The external wall may extend the entire length of the device holder.

The external wall of the device holder may have any suitable length. The length of the external wall may be substantially equal to the length of the housing of the case. Typically, the length of the external wall of the device holder is substantially equal to the length of the aerosol-generating device. In some embodiments, the length of the external wall is greater than the length of the aerosol-generating device. The length of the external wall may be substantially similar to the length of the case. The length of the external wall may be between about 30 mm and about 200 mm.

In some embodiments, the external wall of the device holder is configured to cover the opening of the housing when the device holder is in the closed position. The opening of the housing has a length and the length of the external wall of the device holder may be substantially equal to the length of the opening. In some embodiments, the length of the external wall may be greater than the length of the opening. The opening of the housing has a width and the width of the external wall of the device holder may be substantially equal to the width of the opening. In some embodiments, the width of the external wall may be greater than the width of the opening.

The device holder may comprise any suitable number of internal walls. The device holder may comprise one internal wall. The device holder may comprise two or more internal walls. In some embodiments comprising two or more internal walls, the two or more internal walls may be joined or attached together. In some embodiments comprising two or more internal walls, the internal walls may be separate or spaced from each other.

The one or more internal walls may be arranged in any suitable arrangement. In particular, each of the one or more internal walls may be arranged to extend from the external wall. Each of the one or more internal walls may be arranged to extend from the external wall in a direction substantially perpendicular to the external wall. The one or more internal walls may be arranged to substantially extend along the external wall. The one or more internal walls may be arranged to substantially extend along the external wall from at or around the first end of the device holder. In some embodiments, the one or more internal walls may be arranged to substantially extend along the external wall from at or around the first end of the device holder in a direction towards the second end of the device holder. The device holder comprises a portion or region at or around the second end of the device holder that does not comprise the one or more internal walls. In some embodiments, device holder may also comprise a portion at around the first end of the device holder that does not comprise the one or more internal walls.

In some embodiments, the one or more internal walls comprise a pair of opposing internal walls, each of which has one end that is attached to the external wall and an opposite unattached end that is not attached to the external wall or the other opposing internal wall. In these embodiments, an opening or spacing may be provided between the unattached ends of the opposing internal walls. The opening may be smaller or narrower than the diameter of the aerosol-generating device, such that an aerosol-generating device received in the device holder, between the pair of opposing internal walls, may not pass through the opening or spacing between the unattached ends of the opposing internal walls.

Where the device holder comprises one internal wall, the internal wall may be attached or secured to the external wall at each end to form a tube having a passage for receiving the aerosol-generating device.

Typically, the length of each of the one or more internal walls is less than the length of the external wall. The length of the one or more internal walls of the device holder may be between about 10% and about 90% of the length of the external wall, between about 20% and about 80% of the length of the external wall and may be between about 30% and about 70% of the length of the external wall. The length of the one or more internal walls of the device holder may be no more than 90% of the length of the external wall, no more than 80% of the length of the external wall, no more than 75% of the length of the external wall or no more than 70% of the length of the external wall. The length of the one or more internal walls may be between about 25 mm and about 190 mm.

The length of the gap between the one or more internal walls and the external wall at the second end of the device holder may be between about 5% and about 50% of the length of the external wall, may be between about 10% and about 40% of the length of the external wall and may be between about 10% and about 30% of the length of the external wall. The length of the gap may be between about 5 mm and about 100 mm.

In some embodiments, the opening of the housing may extend substantially over one side of the housing. In some of these embodiments, where the external wall of the device holder is configured to cover the opening of the housing when the device holder is in the closed position, the external wall of the device holder may form a side wall of the housing when the device holder is in the closed position. In other words, the housing and the external wall of the device holder may form an enclosure when the device holder is in the closed position.

The one or more internal walls of the device holder may be configured to be received in the housing when the device holder is in the closed position, such that when the aerosol-generating device is releasably held in the device holder the aerosol-generating device is received in the housing when the device holder is in the closed position. The one or more internal walls of the device holder may be configured to be received in the cavity of the housing when the device holder is in the closed position. Accordingly, an aerosol-generating device received in the device holder between the one or more internal walls and the external wall may be received in the cavity of the housing when the device holder is in the closed position.

The housing and the external wall of the device holder may be arranged to substantially surround or enclose the aerosol-generating device when the aerosol-generating device is received in the device holder, and the device holder is in the closed position. Accordingly, the case may be configured to provide protection for the aerosol-generating device when the aerosol-generating device is received in the device holder and the device holder is in the closed position. In these embodiments, the housing and the external wall of the device holder may substantially prevent or inhibit access to the aerosol-generating device to a user until the device holder is rotated from the closed position to the open position. In other words, a user may be substantially prevented from removing the aerosol-generating device from the device holder when the device holder is in the closed position.

The device holder has a first end and a second end, opposite the first end. The device holder is pivotally coupled to the housing at around the first end. The pivotal coupling may comprise any suitable type of pivotal coupling. For example, the pivotal coupling may comprise one or more of a hinge, a pivot and a linkage.

The device holder may be movable between the open position and the closed position by any suitable means. In some embodiments, the housing may be shaped such that portions of the one or more internal walls are exposed when the device holder is in the closed position. The exposed portions of the device holder may enable a user to grip or grasp the device holder and rotate or pivot the device holder from the closed position into the open position. In some embodiments, the housing may comprise one or more scalloped portions for exposing portions of the internal walls of the device holder when the device holder is in the closed position. In some embodiments, the device holder may be movable from the closed position to the open position by pressing on a portion of the device holder at or around the first end of the device holder. In other words, the device holder may be movable from the closed position to the open position by a trigger action.

The aerosol-generating device may be a handheld device. In other words, the aerosol-generating device may have any size and shape suitable to be held in the hand of a user. The aerosol-generating device may have a size and shape similar to a conventional cigarette or cigar. The aerosol-generating device may be portable.

The aerosol-generating device may have any suitable size and shape.

The aerosol-generating device may have a transverse cross-section of any suitable shape. For example, the aerosol-generating device may have a substantially circular, elliptical, triangular, square, rhomboidal, trapezoidal, pentagonal, hexagonal or octagonal transverse cross-section. In some particular embodiments, the aerosol-generating device has a substantially circular transverse cross-section.

The aerosol-generating device may have a substantially constant transverse cross-section along its length. The aerosol-generating device may have a substantially circular transverse cross-section along its length. The device may have rotational symmetry about its longitudinal axis. The device may have rotational symmetry of an order greater than one about its longitudinal axis. The device may be substantially axisymmetric about its longitudinal axis. In particular embodiments, the aerosol-generating device may be substantially circularly cylindrical.

The aerosol-generating device may have any suitable diameter and any suitable length. The aerosol-generating device may be elongate. In some particular embodiments, the aerosol-generating device may have a shape, diameter and length substantially similar to a conventional cigarette or cigar. The aerosol-generating device may have a length between about 30 mm and about 150 mm. The aerosol-generating device may have an external diameter between about 5 mm and about 30 mm.

The aerosol-generating device may be configured to receive one or more of a cartridge, an atomiser and an aerosol-generating article. The aerosol-generating device may be configured to receive one or more of a cartridge, an atomiser and an aerosol-generating article at a proximal end. The device comprises a cavity for receiving an aerosol-forming substrate. The cavity may be adapted to receive one or more of a cartridge, an atomiser and an aerosol-generating article.

In some embodiments, the aerosol-generating device may comprise an atomiser. Where the aerosol-generating device comprises an atomiser, the device may be configured to receive an article comprising an aerosol-forming substrate or a cartridge comprising an aerosol-forming substrate. In other embodiments, the aerosol-generating device may be configured to receive an atomiser or a combination of an atomiser and an article or a cartridge comprising an aerosol-forming substrate. Where the device comprises a cavity for receiving one or more of a cartridge and an aerosol-generating article, the atomizer may be arranged in the cavity.

The aerosol-generating device may comprise a housing. In particular embodiments, the housing may be substantially circularly cylindrical. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. In particular embodiments, the material is light and non-brittle.

The aerosol-generating device comprises a first rechargeable electrical power supply and the case comprises a second electrical power supply. The second electrical power supply is arranged in the case to supply power to the aerosol-generating device when the aerosol-generating device is received in the device holder and the device holder is in the closed position. As such, the case may be referred to as a charging case.

The first rechargeable electrical power supply may be housed in the housing of the aerosol-generating device. The second electrical power supply may be housed in the housing of the case.

The aerosol-generating device comprises a first electrical connector part and the case may comprises a second electrical connector part. The first and second electrical connector parts may be arranged to releasably electrically engage when the aerosol-generating device is releasably held in the device holder and the device holder is in the closed position. When the first and second connector parts are electrically engaged, power may be supplied from the second electrical power supply of the case to the first rechargeable electrical power supply of the aerosol-generating device to charge the first rechargeable electrical power supply.

The aerosol-generating device comprises a proximal end and an opposing distal end. The device comprises a cavity for receiving an aerosol-forming substrate at the proximal end. The distal end of the device comprises a distal end face and the first electrical connector part is arranged at the distal end face of the aerosol-generating device. Where the aerosol-generating device is elongate, and substantially extends along a longitudinal axis, the distal end face may be substantially perpendicular to the longitudinal axis. The aerosol-generating device may comprise a distal end face, a proximal end face and a sidewall extending between the distal and proximal end faces. A cavity for receiving an aerosol-forming substrate is provided at the proximal end. Optionally, a mouthpiece may be provided at the proximal end. In some embodiments, the aerosol-forming substrate is provided as part of an aerosol-generating article. The aerosol-generating article may comprise a filter. The aerosol-forming substrate and filter may be provided in the form of a rod and secured together by an outer wrapper, such as a sheet of cigarette paper.

In some embodiments, the housing of the case comprises the second connector part. In these embodiments, the second connector part may be arranged at or around the first end of the device holder, when the device holder is in the closed position.

In some embodiments, the device holder of the case comprises the second connector part. In these embodiments, the second connector part may be arranged at or around the first end of the device holder. Where the device holder comprises the second connector part, the second connector part may be electrically connected to electrical circuitry housed in the case housing. The electrical connection may be a wired connection. The electrical connection may be a flexible circuit, such as a flexible printed circuit. A flexible circuit enables movement of the second connector part relative to the housing without damaging the electrical connection. Such flexible circuitry may enable the second connector part to be moved with the device holder, relative to the housing of the case, as the device holder is moved between the open and closed positions.

Where the device holder comprises a passage or channel comprising a closed end, the second electrical connector part may be arranged at a closed end face of the passage or channel. Where the device holder comprises a passage or channel that is open at both ends, the second electrical connector part may be arranged on the housing of the case.

Where the housing comprises a cavity or space for receiving the device holder and the aerosol-generating device when the aerosol-generating device is received in the device holder, the second electrical connector part may be arranged in the cavity or space.

The first and second electrical power supplies may comprise any suitable types of electrical power supplies. For example, the first and second electrical power supplies may comprise one or more of batteries and capacitors. The first and second electrical power supplies may comprise lithium ion batteries. The first and second electrical power supplies may be rechargeable electrical power supplies. The first and second electrical power supplies may be identical. The first and second electrical power supplies may be different. The second electrical power supply of the case may have a larger size than the electrical power supply of the aerosol-generating device. The second electrical power supply of the case may have a larger capacity than the electrical power supply of the aerosol-generating device.

The first and second electrical connector parts may be any suitable type of electrical connector parts. The first and second connector parts may comprise any suitable number of electrical contacts. The first and second electrical connector parts may be configured to transfer power from the second electrical power supply of the case to the first rechargeable electrical power supply of the aerosol-generating device. The first and second electrical connector parts may also be configured to transfer data from at least one of the case to the aerosol-generating device and the aerosol-generating device to the case. In some embodiments, the transfer of data may be one-way, such as from the aerosol-generating device to the case. In other embodiments, the transfer of data may be two-way, from the aerosol-generating device to the case and from the case to the aerosol-generating device.

In some particular embodiments, the first electrical connector part may comprise a face and a recess arranged substantially centrally in the face, the recess having a closed end, an open end at the face and a sidewall extending between the open end and the closed end. The first electrical connector part may further comprise a first electrical contact arranged at the closed end of the recess; a second electrical contact arranged at the sidewall of the recess and substantially circumscribing the first electrical contact; and a third electrical contact arranged at the face and substantially circumscribing the first electrical contact.

In this arrangement, the second and third electrical contacts may form concentric rings or bands. The second electrical contact may form an elongate, thin ring at the sidewall of the recess and the third electrical contact may form a wide flat ring at the face of the first connector part. The first electrode may form a flat circular ring at the end face of the recess.

In some particular embodiments, the second electrical connector part may comprise a face and a projection arranged substantially centrally in the face, the projection having an end face and a sidewall extending between the face and the end face of the projection. The second electrical connector part may further comprise: a first electrical contact arranged at the end face of the projection; a second electrical contact arranged at the at least one sidewall of the projection and spaced radially outwardly from the first electrical contact; and a third electrical contact arranged at the face spaced radially outwardly from the first electrical contact.

In these particular embodiments, any of the first, second and third contacts may be configured to transfer power from the power supply of the charging case to the rechargeable power supply of the aerosol-generating device. Similarly, any of the first, second and third contacts may be configured to transfer data between the charging case and the aerosol-generating device. However, typically the second electrical contacts of the first and second connector parts are configured to transfer data between the charging case and the aerosol-generating device.

The case may comprise electrical circuitry. The electric circuitry may be configured to control the transfer or supply of power from the case to the aerosol-generating device when the first and second connector parts are in electrical engagement. The electric circuitry may be configured to control the transfer of data from one or more of the case to the aerosol-generating device and the aerosol-generating device to the case. The electric circuitry may comprise a microprocessor.

The aerosol-generating device may comprise electrical circuitry. The electric circuitry may be configured to control the transfer of power from the case to the aerosol-generating device when the first and second connector parts are in electrical engagement. The electric circuitry may be configured to control the transfer of data from one or more of the case to the aerosol-generating device and the aerosol-generating device to the case. The electric circuitry may comprise a microprocessor.

The case may comprise means for releasably retaining the housing and the device holder in the closed position.

In some embodiments, the device holder may be configured to have a close fit or a friction fit in the opening of the housing. The close fit or friction fit may releasably retain the housing and the device holder in position by friction.

In some embodiments, the case may comprise resilient means, such as a torsion spring. In these embodiments, a user may be required to exert a force against the resilient means to move the device holder between the open position and the closed position. In some embodiments, the resilient means may be configured to have more than one stable position, such as a bistable torsion spring. In these embodiments, the bistable spring may be arranged to be in a stable state when the device holder is in the open position and when the device holder is in the closed position.

In some embodiments, one of the housing and the device holder may be provided with a moveable catch for releasably securing the device holder in the closed position. In these embodiments, the housing may be provided with a button configured to move the catch when pressed to release the device holder from the closed position.

In some embodiments, the device holder may be provided with a first magnetic material and the housing may be provided with a second magnetic material. The first and second magnetic materials may be arranged such that the first and second magnetic materials are proximate or adjacent to each other when the device holder is in the closed position. The first and second magnetic materials may be arranged such that the first and second magnetic materials are attracted to each other when the device holder is in the closed position.

The term 'magnetic material' is used herein to describe a material which is able to interact with a magnetic field, including both paramagnetic and ferromagnetic materials. A magnetisable material may be a paramagnetic material, such that it only remains magnetised in the presence of an external magnetic field. Alternatively, a magnetisable material may be a material which becomes magnetised in the presence of an external magnetic field and which remains magnetised after the external field is removed (a ferromagnetic material, for example). The term "magnetic material" as used herein encompasses both types of magnetisable material, as well as material which is already magnetised.

At least one of the first and second magnetic materials may comprise an alloy of neodymium, such as neodymium, iron and boron. In other words, at least one of the first and second magnetic materials may be a neodymium magnet. At least one of the first and second magnetic materials may comprise a ferromagnetic stainless steel, such as SS430 stainless steel.

Where the case comprises means for releasably retaining the housing and the device holder in the closed position, the case may also comprise means for biasing the housing and the device holder into the open position. The housing may be provided with one or more springs, arranged to pivot or rotate the device holder into the open position.

The case may also comprise retaining means for releasably retaining the aerosol-generating device in the device holder.

The retention means may be any suitable means for releasably retaining the aerosol-generating device in the device holder. For example, the retention means may comprise a friction fit between the aerosol-generating device and the device holder, when the aerosol-generating device is received by the device holder. For example, the retention means may comprise resilient means arranged on the housing of the case to urge the aerosol-generating device into the device holder when the device holder is in the closed position.

In some particular embodiments, the retention means may comprise magnetic retention means. The magnetic retention means may comprise a first magnetic material and a second magnetic material. The first magnetic material may be provided in the aerosol-generating device and the second magnetic material may be provided in the case.

The first and second magnetic materials may be arranged such that the first and second magnetic materials are proximate each other when the aerosol-generating device is received by the device holder. The first and second magnetic materials may be arranged such that the first and second magnetic materials are attracted to each other when the aerosol-generating device is received by the device holder.

The first magnetic material may be arranged at or towards the distal end of the aerosol-generating device and the second magnetic material may be arranged at or towards the first end of the device holder or in the housing towards the first end of the device holder when the device holder is in the closed position. The first magnetic material may be arranged at a distal end face of the aerosol-generating device. Where the device holder comprises a sleeve having a closed end face at or around the first end, the second magnetic material may be arranged at the closed end face of the sleeve. Where the device holder comprises an electrical connector part at or around the first end of the device holder, the first magnetic material may be arranged at the electrical connector part. Where the device holder comprises a sleeve having a closed end face and an electrical connector part at the closed end face, the first magnetic material may be arranged at the electrical connector part.

In some particular embodiments described above, the aerosol-generating device comprises a first electrical connector part comprising a face and a recess arranged substantially centrally in the face, the recess having a closed end, an open end at the face and a sidewall extending between the open end and the closed end. The first connector part further comprises: a first electrical contact arranged at the closed end of the recess; a second electrical contact arranged at the sidewall of the recess and substantially circumscribing the first electrical contact; and a third electrical contact arranged at the face and substantially circumscribing the first electrical contact.

In these particular embodiments, at least one of the electrical contacts of the first connector part may be formed from a magnetic material. In particular, the third electrical contact may be formed from a magnetic material.

In these particular embodiments, the second connector part may comprise a face and a projection arranged substantially centrally in the face, the projection having an end face and a sidewall extending between the face and the end face of the projection. The second connector part further comprises: a first electrical contact arranged at the end face of the projection; a second electrical contact arranged at the at least one sidewall of the projection and spaced radially outwardly from the first electrical contact; and a third electrical contact arranged at the face spaced radially outwardly from the first electrical contact.

In these particular embodiments, two bodies of magnetic material may be arranged on opposite sides of the electrical contacts of the second connector part. The two bodies of magnetic material may be electrically isolated from the electrical contacts of the second connector part. The two bodies of magnetic material may be substantially arcuate and may have a similar or the same curvature as the third electrical contact of the first connector part.

According to another aspect of the present invention, there is provided a case configured to receive an aerosol-generating device. The case comprises a housing having an opening and a device holder pivotally coupled to the housing and pivotable relative to the housing between an open position and a closed position. The device holder comprises an external wall and one or more internal walls arranged to releasably hold an aerosol-generating device. The device holder has a first end and a second end, opposite the first end. The device holder is pivotally coupled to the housing at or around the first end.

In some embodiments, the case comprises an electrical power supply and an electrical connector part electrically connected to the electrical power supply, the electrical connector part being arranged at or around the first end of the device holder when the device holder is in a closed position.

The electrical connector part may comprise a face and a projection arranged substantially centrally in the face, the projection having an end face and a sidewall extending between the face and the end face of the projection. The electrical connector part may further comprise: a first electrical contact arranged at the end face of the projection; a second electrical contact arranged at the at least one sidewall of the projection and spaced radially outwardly from the first electrical contact; and a third electrical contact arranged at the face spaced radially outwardly from the first electrical contact.

In some embodiments, a portion of the device holder at or around the second end does not comprise the one or more internal walls.

It will be appreciated that features described in relation to the first aspect of the present invention may also be applied equally to the second aspect of the present invention and vice versa.

FIG. 1 shows a schematic illustration of a known electrically operated aerosol-generating system. The known electrically operated aerosol-generating system comprises a case 1, an aerosol-generating device 20 and an aerosol-generating article 30.

The case 1 comprises a housing 2 having the general size and shape of a conventional packet of cigarettes. A lithium-ion battery 3 and electric circuitry 4 are housed within the case 1. The case 1 further comprises a generally circularly-cylindrical cavity 5 for receiving the aerosol-generating device 20. The cavity 5 is defined by the housing 2. An electrical connector part (not shown) is arranged at a closed end of the cavity 5 for electrically connecting an aerosol-generating device received in the cavity 5 to the battery 3 of the case 1.

The aerosol-generating device 20 is substantially circularly cylindrical and has the general dimensions of a conventional cigar. The length of the device 20 is substantially identical to the length of the cavity 5 and the diameter of the device 20 is slightly smaller than the diameter of the cavity 5, such that the device 20 fits closely in the cavity 5. The aerosol-generating device 20 comprises an open cavity 21 at a proximal end for receiving an aerosol-generating article. The aerosol-generating device 20 comprises an electrical connector part (not shown) at a distal end face, opposite the proximal end. The aerosol-generating device 20 further comprises a battery (not shown) housed in the housing of the device and an electric heater (not shown) arranged in the cavity 21 for heating at least a portion of the aerosol-generating article 30 when the aerosol-generating article 30 is received in the cavity 21.

The aerosol-generating article 30 comprises an aerosol-forming substrate (not shown) comprising a gathered, crimped sheet of tobacco, and a filter (not shown) arranged back to back with the aerosol-forming substrate in the form of a rod. The aerosol-generating article 30 has a diameter substantially equal to the diameter of the cavity 21 of the device 20 and a length longer than the cavity 21, such that when the article 30 is received in the cavity 21 of the device 20, the filter extends out of the cavity 21 and may be drawn on by a user, similarly to a convention cigarette.

In use, a user inserts the article 30 into the cavity 21 of the device 20 and turns on the device 20 to activate the electric heater. The electric heater heats the aerosol-forming substrate of the article 30 such that volatile compounds of the aerosol-forming substrate are released and atomised to form an aerosol. The user draws on the filter of the article 30 and inhales the aerosol generated from the heated aerosol-forming substrate.

After use of the device 20, the article 30 may be removed from the device 20 for disposal, and the device 20 may be placed into the case 1 for storage and for charging of the battery of the device 20. To place the article 30 in the case 1, it is necessary to closely align the longitudinal axis of the device 20 with the longitudinal axis of the cavity 5 of the case 1. When the device 20 is aligned with the cavity 5, the distal end of the device 20 may be inserted into the open end of the cavity 5. In some embodiments, a lid is provided to close the open end of the cavity and retain the device 20 in the cavity 5.

FIGS. 2 to 5 show schematic illustrations of an electrical connector comprising a first connector part 40 and a second connector part 50. The electrical connector of FIGS. 2 to 5 may be suitable for use with any of the embodiments of the present invention described herein.

Figure 2:
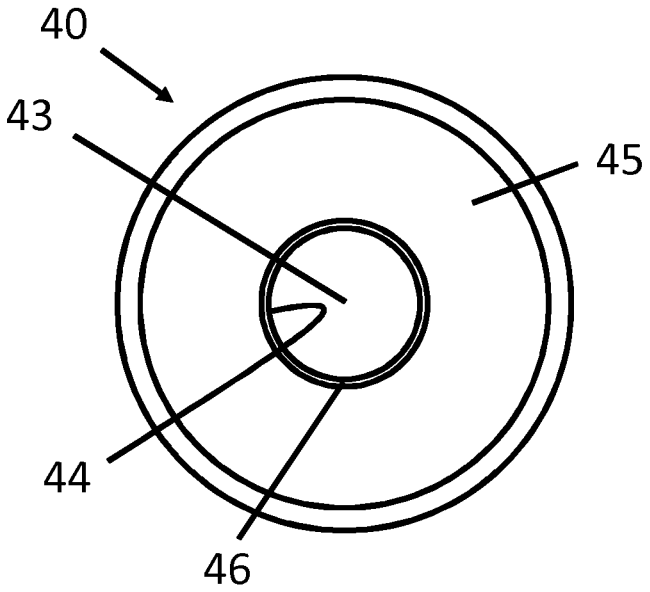
FIG. 2 shows a schematic illustration of a first connector part of an electrical connector according to an embodiment of the present invention.
Figure 3:
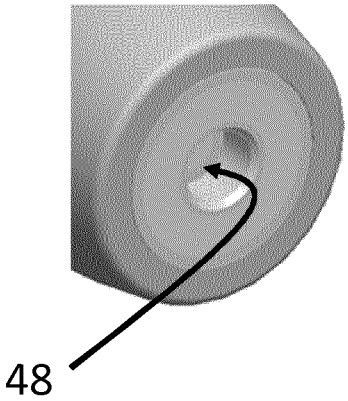
FIG. 3 shows a perspective view of the first connector part of FIG. 2.

FIGS. 2 and 3 show the first connector part 40, which may be arranged at a distal end face of an aerosol-generating device (not shown). The first connector part 40 comprises three electrical contacts, a first electrical contact 43, a second electrical contact 44 and a third electrical contact 45.

The first connector part 40 comprises a substantially circular planar face 46 with a recess 48 located at the centre of the face. The recess 48 is substantially circularly cylindrical, having an open end at the face 46, an opposite closed end and a tubular sidewall extending between the open end and the closed end face. The closed end face of the recess is substantially circular and lies on a plane substantially parallel to the plane of the face 46. The circular face 46 has a diameter of about 10 mm and the recess 48 has a diameter of about 4 mm and a depth of about 4 mm.

The first electrical contact 43 is substantially circular and extends substantially over the closed end face of the recess 48. The outer edge of the first electrical contact 43 is defined by the sidewall of the recess 48, and so the diameter of the first electrical contact is the same as the diameter of the recess. The second electrical contact 44 is substantially tubular and extends substantially over the tubular sidewall of the recess 48. The second electrical contact 44 has a thickness of about 0.1 mm, such that positioning the second electrical contact 44 in the recess 48 does not significantly reduce the diameter of the recess 48. The second electrical contact 44 has a width of about 3.8 mm, and is positioned in the recess 48 such that the second electrical contact 44 does not extend to the closed end face of the recess 48. This positioning ensures that the second electrical contact 44 does not contact the first electrical contact 44. The third electrical contact 45 is substantially annular and extends substantially over the face 46. The third electrical 45 contact has an outer diameter of about 8 mm and an inner diameter of about 4.6 mm, such that the third electrical contact 45 does not contact the second electrical contact 44. In this arrangement, the first, second and third electrical contacts 43, 44, 45 are all electrically isolated from each other. In this embodiment, the first electrical contact is formed from a copper alloy, the second electrical contact is formed from SS304 stainless steel and third electrical contact 45 is formed from SS430 stainless steel.

Figure 4:
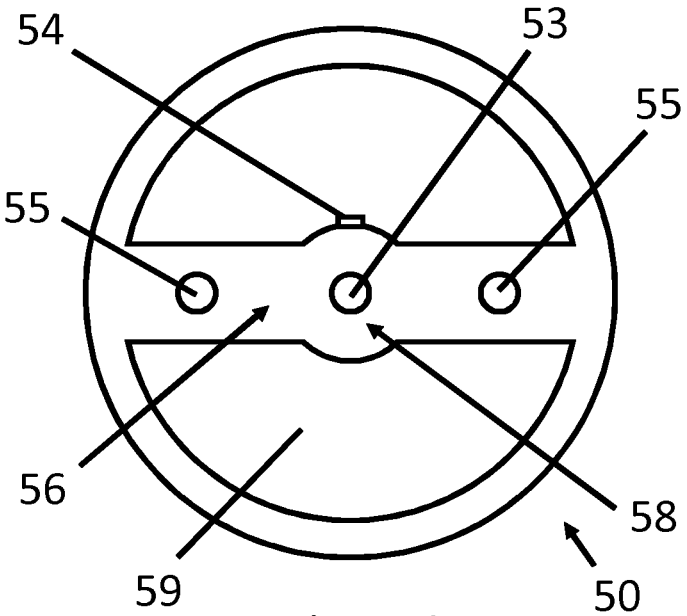
FIG. 4 shows a schematic illustration of a second connector part of an electrical connector according to an embodiment of the present invention, the second connector part being compatible with the first connector part of FIGS. 2 and 3.
Figure 5:
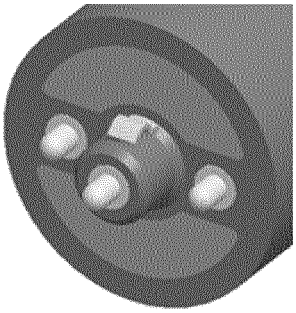
FIG. 5 shows a perspective view of the second connector part of FIG. 4.
Figure 6:
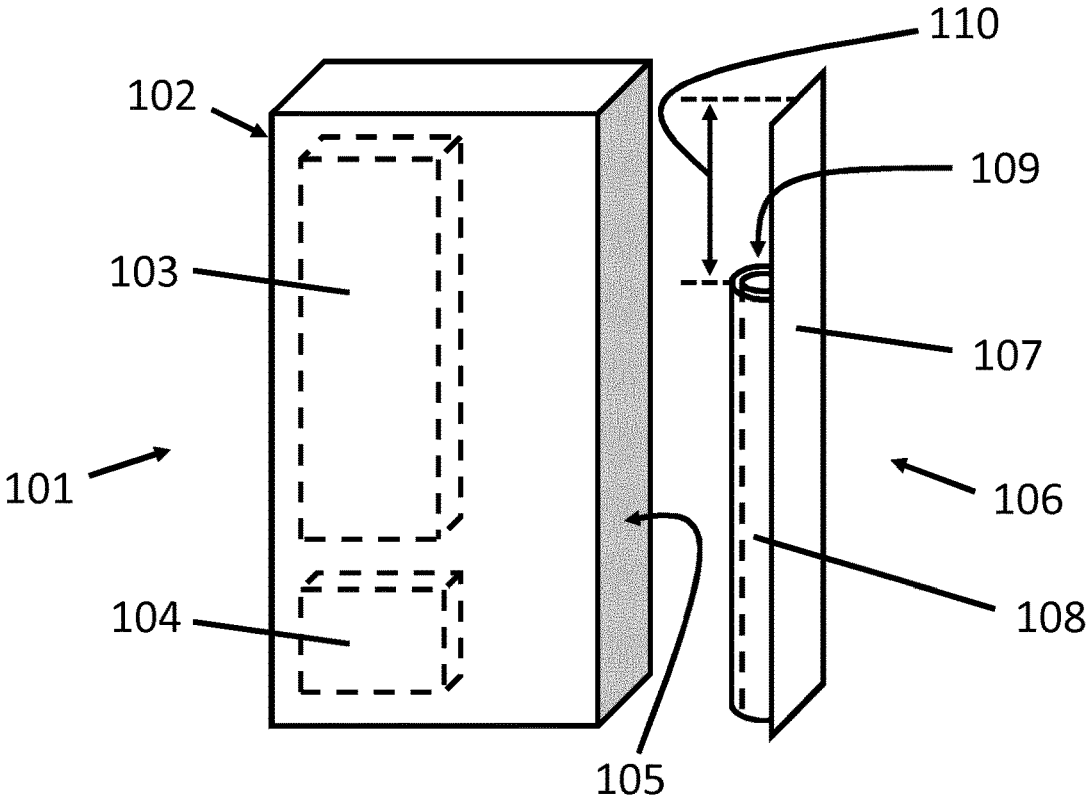
FIG. 6 shows a schematic illustration of a case for an aerosol-generating device according to an embodiment of the present invention with the device holder separated from the housing of the case.

FIGS. 4 and 5 show the second connector part 50, which may be arranged at a closed end face of a cavity of a charging case (not shown). The second connector part 50 comprises four electrical contacts, a first electrical contact 53, a second electrical contact 54 and two third electrical contacts 55.

The second connector part 50 comprises a substantially circular planar face 56 with a projection 58 located at the centre of the face. The projection 58 extends outwards from the face 56 in a direction substantially perpendicular to the plane of the face 56. The projection 58 is substantially circularly cylindrical and comprises an end face and a tubular sidewall extending between the face 56 and the open end face of the projection. The end face of the projection 58 is substantially circular and lies on a plane substantially parallel to the plane of the face 56. The projection has substantially the same shape as the recess 48 of the first connector part 40, has a height of about 3 mm and has a maximum diameter slightly smaller than the recess 48 of about 3.3 mm, such that the projection 58 of the second connector part 50 may fit closely within the recess 48 of the first connector part 40. The diameter or width of the projection 58 reduces towards the end face of the projection, such that the interface between the end face and the sidewall of the projection 58 is bevelled to make it easier to locate the projection 58 within the recess 48 of the first connector part 40.

The first electrical contact 53 is a pogo pin contact arranged on the end face of the projection 58. The first electrical contact 53 extends outwards from the end face of the projection 58, substantially in the same direction as the projection. The second electrical contact 54 is a leaf spring arranged at the sidewall of the projection 58. The second electrical contact 54 extends radially outwards from the sidewall of the projection 58, in a direction substantially perpendicular to the sidewall and substantially parallel with the plane 56, by a maximum distance of about 0.3 mm. The two third electrical contacts 55 are pogo pin contacts substantially similar to the first electrical contact 53. The two third electrical contacts 55 extend outwards from the face 56 in a direction substantially perpendicular to the face 56 and substantially parallel to the first electrical contact 53.

The two third electrical contacts 55 are spaced radially outwardly from the first electrical contact 53 in opposite directions, such that the first electrical contact 53 and the two third electrical contacts 55 are arranged substantially in a line. The two third electrical contacts 55 are spaced from the first electrical contact 53 by substantially equal distances of about 2.75 mm measured from the central axes of the contacts. The distance between the third electrical contacts 54 and the first electrical contact 53 of the second connector part 50 is greater than the diameter of the projection 58.

In this embodiment, the pogo pin contacts 53, 55 are formed from brass and the leaf spring contact 54 is formed from SS301 stainless steel.

The pogo pin contacts 53, 55 typically extend about 1 mm above the face from which they extend when they are not compressed, and about 0.5 mm above the face from which they extend when they are compressed.

The first and second connector parts 40, 50 comprise magnetic retention means. The magnetic retention means comprises a first magnetic material in the form of the third electrical contact 45 of the first connector part 40, which comprises a ring or band of a ferromagnetic metal. The magnetic retention means further comprises a second magnetic material 59 comprising a pair of arcuate bodies of a ferromagnetic material arranged at opposite sides of the electrical contacts of the second connector part 50. The second magnetic material 59 is electrically isolated from the electrical contacts of the second connector part 50.

In this embodiment, the third electrical contact 45 of the first connector part 40 (i.e. the first magnetic material) is formed from a ferromagnetic stainless steel, such as SS430 stainless steel, and the second magnetic material 59 is formed of an alloy of neodymium, iron and boron that is magnetised to form a permanent magnet.

When the first connector part 40 is moved into the proximity of the first connector part 50, the magnetic attraction between the first and second magnetic materials draws the first and second connector parts together, compressing the pogo pin contacts 53, 55 of the second connector part 50 and brining the electrical contacts of each connector part into electrical engagement. The magnetic retention means helps to retain the first and second connector parts in electrical engagement. When the first and second connector parts are in electrical engagement, the force required to overcome the magnetic attraction force and disengage the first and second connector parts is typically between about 1 N and 5 N, such as around 2 N.

FIGS. 6 to 10 show schematic illustrations of a case 101 according to a first embodiment of the present invention. The case 101 is configured to receive an aerosol-generating device, such as the aerosol-generating device 20 described above in the known electrically operated aerosol-generating system shown in FIG. 1.

The case 101 comprises a housing 102 and a device holder 106.

The housing 102 houses a lithium ion battery 103 and electric circuitry 104. The housing 102 also defines a cavity 105 that is shaped and dimensioned to receive a portion of the device holder 106 and an aerosol-generating device, when an aerosol-generating device is received in the device holder 106.

The housing 102 generally forms an open rectangular box having sidewalls defining five sides of the box and an opening at a sixth side of the box. The opening forms an open end of the cavity 105 and extends substantially the length and width of one side of the housing 102. The housing 102 has the general shape and dimensions of a conventional packet of cigarettes.

The device holder 106 comprises an external wall 107 and an internal wall 108.

The external wall 107 is elongate and has a length substantially identical to the length of the housing 102. The length of the external wall 107 defines the length of the device holder 106. The external wall 107 is shaped and dimensioned to cover the opening of the housing 102. As such, the external wall 107 is shaped and dimensioned as a sixth sidewall of the housing 102.

The internal wall 108 forms a substantially circularly cylindrical tube, defining a generally circularly cylindrical inner passage 109 that extends the length of the internal wall 108. The passage 109 is open at one end and closed at the other end, opposite the open end. The passage 109 has a transverse cross-section along its length that is substantially identical to the transverse-cross section of an aerosol-generating device, the diameter of the inner passage 109 being slightly larger than an aerosol-generating device, such that an aerosol-generating device may be removably held in the inner passage 109 of the device holder 106.

The tubular internal wall 108 of the device holder 106 is integrally formed with the external wall 107. It will be appreciated that in some embodiments, the internal wall 108 may not be integral with the external wall 107 and may instead be attached to the external wall 108 by any suitable attachment means. The tubular internal wall 108 is arranged with its longitudinal axis substantially aligned with the longitudinal axis of the external wall 108. The closed end of the passage 109 is arranged at a first end of the external wall 107 and the internal wall is arranged to extend along the external wall 107 from the first end towards the second end. The length of the internal wall 108 is less than the length of the external wall 107. As such, the internal wall 108 does not extend along the entire length of the external wall 107. A portion of the device holder 106 at the second does not comprise the internal wall 108. In other words, the internal wall 108 does not extend the length of the device holder 106 from the first end to the second end. The length of the internal wall 108 is about 70% of the length of the external wall 107. As such, a space or gap 110 is provided between the end of the internal wall 108 towards the second end of the device holder 106 and the end of the external wall 107 at the second end of the device holder 106.

The device holder 106 is pivotally coupled 111 to the housing at the first end. In particular, the external wall 107 is pivotally coupled to the housing 102 at one end of the opening of the cavity 105. The pivotal coupling 111 enables the device holder 106 to be pivoted or rotated relative to the housing 102 between an open position, in which the open end of the passage 109 towards the second end of the device holder 106 is exposed, and a closed position, in which the open end of the passage 109 is hidden by the housing 102 and the opening of the housing 102 is covered by the external wall 107 of the device holder 106.

The internal wall 108 of the device holder 106 is received in the cavity 105 of the housing 102 when the device holder 106 is rotated into the closed position. When an aerosol-generating device is received in the inner passage 109 of the device holder 106, and the device holder is rotated into the closed position, the aerosol-generating device is enclosed in the cavity 105, as it is surrounded or enclosed by the walls of the housing 102 and the external wall 107 of the device holder 106. In this position, an aerosol-generating device received in the device holder may be substantially protected by the case when the device holder is in the closed position.

An electrical connector part (not shown) is arranged at the closed end of the inner passage 109, for engagement with a complimentary electrical connector part at a distal end face of an aerosol-generating device received in the inner passage 109. The electrical connector part may be identical to the second electrical connector part 50 shown above in FIGS. 4 and 5. The electrical connector part is electrically connected to the electric circuitry 104 in the housing 102 of the case 101 via a flexible printed circuit (not shown) that enables movement of the electrical connector part with the device holder without damaging the electrical connection.

Figure 7:
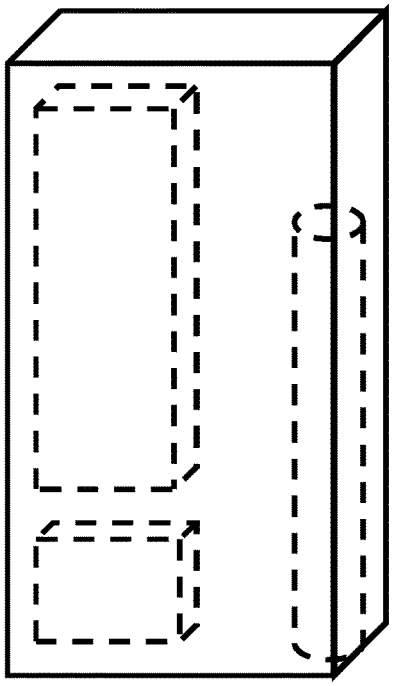
FIG. 7 shows a schematic illustration of a the case of FIG. 2 with the device holder in a closed position.
Figure 8:
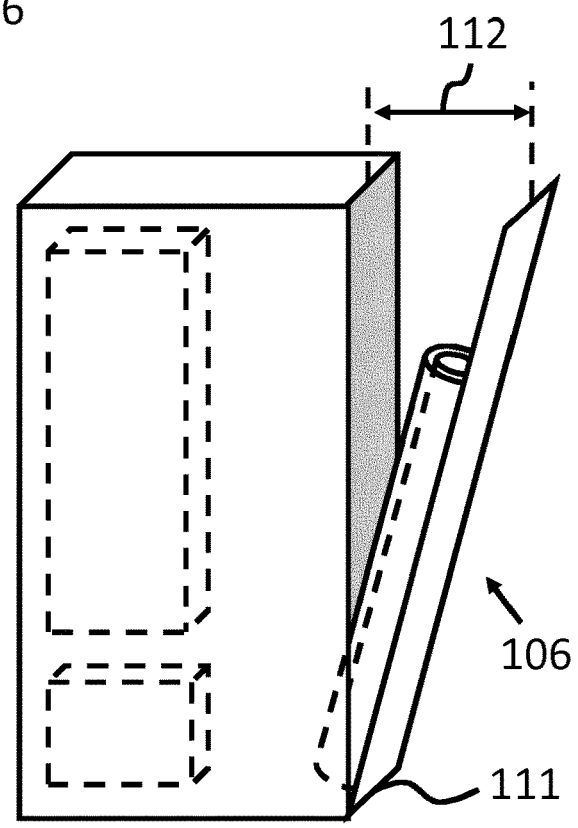
FIG. 8 shows a schematic illustration of the case of FIG. 2 with the device holder in an open position.

FIGS. 7 and 8 show schematic illustrations of the case 101 wherein the device holder 106 is rotated about the pivotal coupling 111 relative to the housing 102 between the closed position and the open position, respectively.

The device holder 106 is pivotable relative to the housing 102 between two predetermined positions, the closed position and the open position. The device holder 106 is pivotable in a first direction, to rotate the device holder 106 relative to the housing 102 from the open position to the closed position. The external wall 107 of the device holder 106 overlaps with the housing 102, such that external wall 107 makes contact with the housing 102 when the device holder 106 is in the closed position to prevent the device holder 106 from being rotated further in the first direction beyond the closed position. The device holder 106 is also pivotable in a second direction, opposite the first direction, to rotate the device holder 106 relative to the housing 102 from the closed position to the open position. The cavity 105 of the housing 102 comprises a stop (not shown) which is arranged to contact the internal wall 108 of the device holder 106 when the device holder 106 is in the open position to prevent the device holder 106 from being rotated in the second direction beyond the open position.

FIG. 8 shows the device holder 106 in the open position. In this embodiment, in the open position, the opening 112 between the housing 102 and the first end of the external wall 107 of the device holder 106 has a width or diameter that is about double the width or diameter of the aerosol-generating device. It will be appreciated that in some embodiments, the device holder may be pivotal relative to the housing to different angles, which provide openings between the housing and the first end of the external wall of the device holder having different widths.

The wide opening 112 and the gap 110 between the second end of the internal wall 108 and the second end of the external wall 107 enable an aerosol-generating device to be inserted into the device holder 106 from a wide range of angles. In particular, the gap 110 enables an aerosol-generating device to make contact with the external wall 107 when the aerosol-generating device is being inserted into the device holder 106. This may enable the portion of the external wall 107 without the internal wall 108 at the second end of the device holder 106 to be used as a guide for aligning the aerosol-generating device with the passage 109 of the tubular internal wall 108. This may further facilitate insertion of an aerosol-generating device into the device holder 106.

Figure 9:
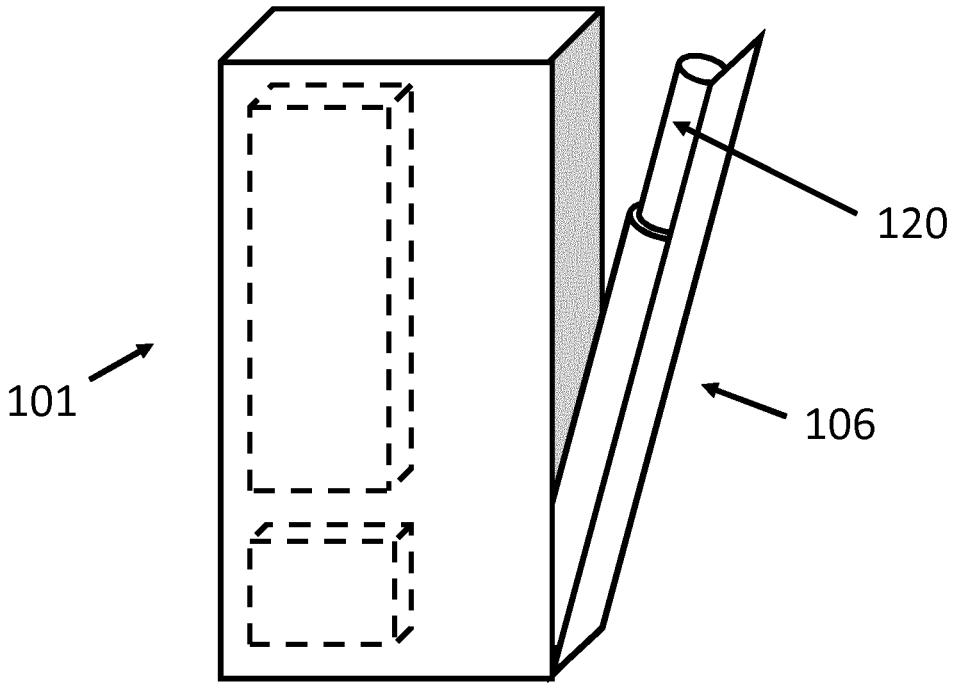
FIG. 9 shows a schematic illustration of the case of FIG. 2 with the device holder in an open position and an aerosol-generating device received in the device holder.
Figure 10:
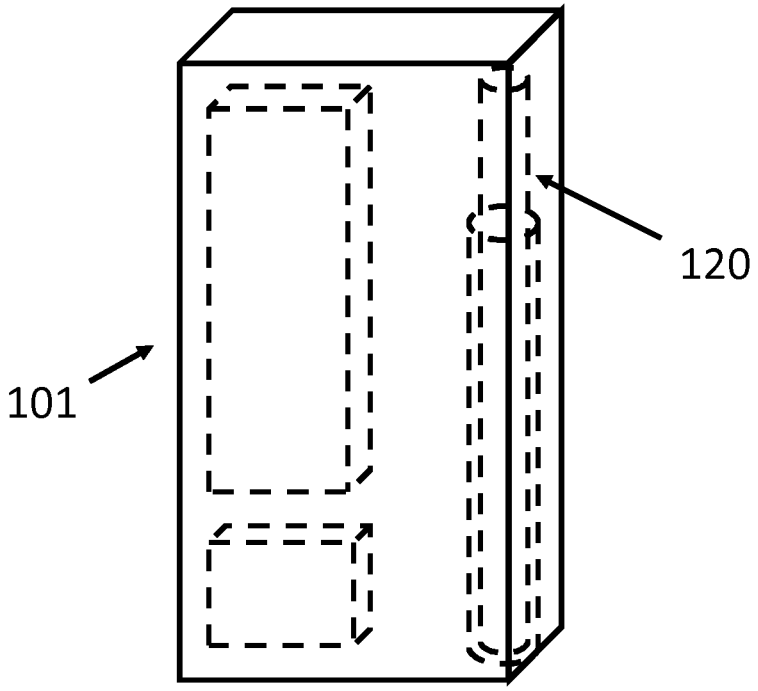
FIG. 10 shows a schematic illustration of the case of FIG. 2 with the device holder in a closed position and an aerosol-generating device received in the device holder.

FIGS. 9 and 10 show an aerosol-generating device 120 releasably held in the device holder 106 of the case 101 with the device holder in the closed position and the open position, respectively.

FIG. 9 shows an aerosol-generating device 120 received in the device holder 106 with the device holder 106 in the open position. The aerosol-generating device 120 is identical to the aerosol-generating device 20 described above in the known system. As shown in FIG. 9, the gap 110 between the second end of the internal wall 108 and the second end of the external wall 107 exposes a portion of the aerosol-generating device 120 at the proximal end of the device 120. This exposed portion at the proximal end of the device 120 may be accessed and grasped by a user for removing the device 120 from the device holder 106. Accordingly, the device holder 106 does not require a lifting mechanism for lifting the device 120 out of the device holder 106. This may reduce the cost and simplify the design of the device holder 106 compared to device holders that include lifting mechanisms for removing devices.

FIG. 10 shows the aerosol-generating device 120 held in the device holder 106 with the device holder 106 in the closed position. The aerosol-generating device 120 is entirely enclosed in the cavity 105 of the housing 102, being surrounded by the housing 102 and the external wall 107 of the device holder 106. In this configuration, the aerosol-generating device 120 is substantially protected by the case 101.

An electrical connector (not shown) is provided at the closed end of the passage 109 for electrically connecting the aerosol-generating device 120 to the battery 103, via the electric circuitry 104, of the case 101, when the aerosol-generating device 120 is received in the device holder 106 and the device holder 106 is in the closed position. Accordingly, the case 101 is configured to supply power to the aerosol-generating device 120 for charging the aerosol-generating device 120, when the aerosol-generating device is received in the device holder 106 and the device holder 106 is in the closed position.

Figure 11:
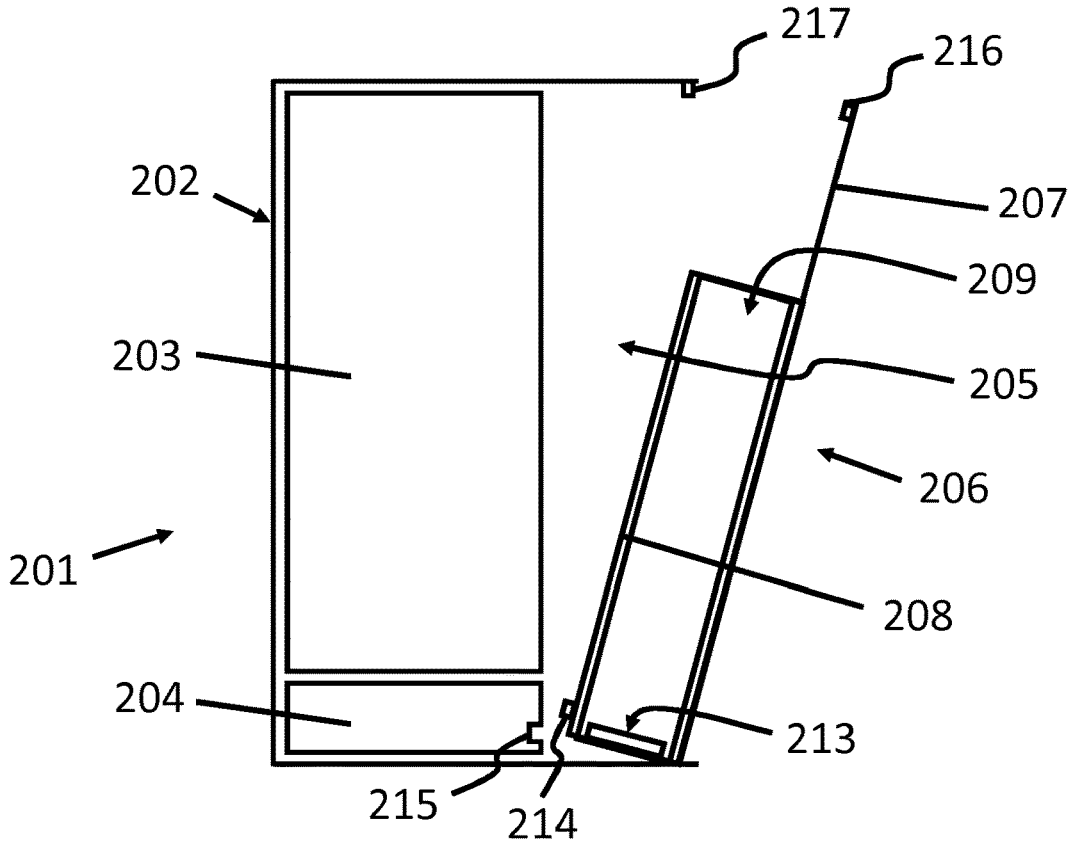
FIG. 11 shows a schematic cross-section of a case according to another embodiment of the present invention, with the device holder in an open position.
Figure 12:
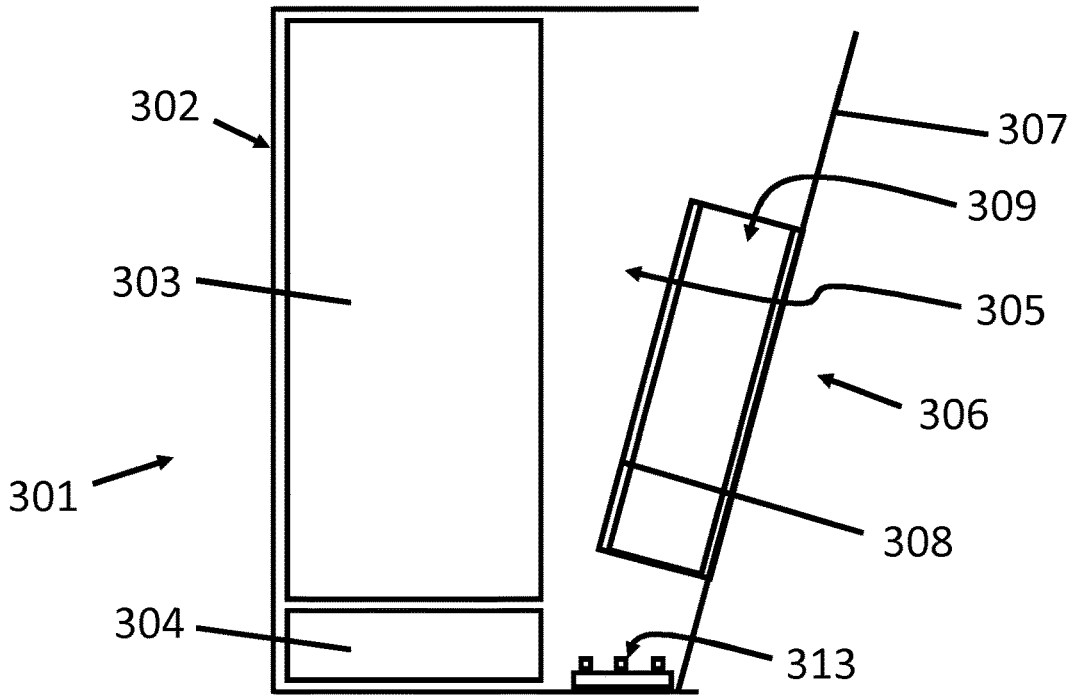
FIG. 12 shows a schematic cross-section of a case according to another embodiment of the present invention, with the device holder in an open position.

FIGS. 11 and 12 show schematic illustrations of other embodiments of cases according to the present invention.

FIG. 11 shows a case 201 according to a second embodiment of the present invention. The case 201 is substantially similar to the case 101 of the first embodiment described above. The case 201 comprises a housing 202 and a device holder 206. The housing 202 houses a battery 203, circuitry 204 and a cavity 205 for receiving the device holder 206. The device holder 206 includes an external wall 207 and a tubular internal wall 208 defining a passage 209 having a closed end at a first end of the device holder 206 and an open end at a second end of the device holder 206. The device holder 206 is pivotally coupled to the housing 202 at the first end, such that the device holder 206 may be rotated between an open position, where the external wall 207 at the second end of the device holder 206 is spaced from the housing 202, and a closed position, where the external wall 207 covers the opening of the cavity 205 and the external wall 207 is in contact with the housing 202 at the second end.

The internal wall 208 is generally circularly cylindrical and comprises a generally circularly cylindrical inner passage 209. The internal wall 208 extends generally along the external wall 207 from the first end in a direction towards the second end. The internal wall 208 extends about 70% of the length of the external wall 207, such that a gap is provided between the internal wall 208 and the external wall 207 at the second end of the device holder 206. The internal wall 208 is received in the cavity 205 of the housing 202 when the device holder 206 is in the closed position. The external wall 207 is arranged to cover the opening of the cavity 205 to enclose an aerosol-generating device received in the device holder 206 within the housing 205 and the external wall 207 of the device holder 206 when the device holder 206 is in the closed position. The external wall 207 generally forms a side wall of the housing 202 when the device holder 206 is in the closed position.

A first electrical connector part 213 is arranged at the closed end of the passage 209. The first electrical connector part 213 is configured to electrically engage with a second part of an electrical connector (not shown) arranged at a distal end of an aerosol-generating device, when the aerosol-generating device is received in the device holder 206. The device holder 206 further comprises an electrical connector part 214 that is configured to electrically engage with a complimentary electrical connector part 215 of the electrical circuitry 204 in the housing 202 when the device holder 206 is in the closed position relative to the housing 202. When the device holder 206 is in the closed position, the electrical circuitry 204 is configured to supply power from the battery 203 of the case 201 to an aerosol-generating device received in the device holder 206, via the electrical connector part 213 at the closed end of the passage 209. The electrical connector part 214 electrically disengages from the complimentary electrical connector part 215 of the electrical circuitry 204 when the device holder 206 is pivoted out of the closed position, so that power may not be supplied to an aerosol-generating device received in the device holder 206 from the battery 203 of the case 201, when the device holder 206 is not in the closed position.

It will be appreciated that in other embodiments, the first electrical connector part 213 may be connected to the electrical circuitry 204 of the case via a flexible wired connection. The flexible wired connection may be a flexible printed circuity.

The case 201 is further provided with magnetic retaining means for releasably retaining the device holder in the closed position. The magnetic retaining means comprise a first magnetic material 216 arranged at the second end of the device holder and a second magnetic material arranged 217 on the housing at a position adjacent to the second end of the device holder when the device holder is in the closed position. The first magnetic material 216 is a body of ferrous material and the second magnetic material 217 is a permanent magnet. The first magnetic material 216 and the second magnetic material 217 are arranged to magnetically attract such that the device holder 206 is urged or biased into the closed position. The magnetic attraction between the first and second magnetic materials 216, 217 requires a user to apply additional force to the device holder 206 to pivot the device holder 206 from the closed position to the open position.

FIG. 12 shows a case 301 according to another embodiment of the present invention. The case 301 is substantially similar to the cases 101, 201 of the embodiments shown in FIGS. 6 to 11 described above. The case 301 comprises a housing 302 and a device holder 306. The housing 302 houses a battery 303, circuitry 304 and a cavity 305 for receiving the device holder 306. The device holder 306 includes an external wall 307 and a tubular internal wall 308 defining a passage 309 having open ends at both the first and second ends of the device holder 306. The device holder 306 is pivotally coupled to the housing 302 at the first end, such that the device holder 306 may be rotated between an open position, where the external wall 307 at the second end of the device holder 306 is spaced from the housing 302, and a closed position, where the external wall 307 covers the opening of the cavity 305 and the external wall 307 is in contact with the housing 302 at the second end.

The internal wall 308 is generally circularly cylindrical and comprises a generally circularly cylindrical inner passage 309. The internal wall 308 extends generally along the external wall 307 from close to the first end to towards the second end. The internal wall 308 extends about 60% of the length of the external wall 307, such that a gap is provided between the internal wall 308 and the external wall 307 at the first and second ends of the device holder. The internal wall 308 is received in the cavity 305 of the housing 302 when the device holder 306 is in the closed position. The external wall 307 is arranged to cover the opening of the cavity 305 to enclose an aerosol-generating device received in the device holder 306 within the housing 305 and the external wall 307 of the device holder 306 when the device holder 306 is in the closed position. The external wall 307 generally forms a side wall of the housing 302 when the device holder 306 is in the closed position.

The open end of the passage 309 at the first end of the device holder 306 enables an aerosol-generating device received in the device holder to extend through the passage 309 and contact the housing 302 at a position close to the pivotal coupling.

The case 301 comprises a first electrical connector part 313 of in the cavity 305 of the housing 302, close to the pivotal coupling between the housing 302 and the device holder 306. The first electrical connector part 313 is arranged such that the distal end of an aerosol-generating device received in the device holder 306 may contact the first connector part 313 when the device holder 306 is in the closed position. A second electrical connector part (not shown) may be arranged at a distal end face of an aerosol-generating device and the second electrical connector part may electrically engage with the first electrical connector part 313 when the aerosol-generating device is received in the passage 309 of the device holder 306 and the device holder 306 is in the closed position. In this embodiment, the first electrical connector part 313 is fixedly electrically engaged to the electrical circuitry 304. The second electrical connector part at the distal end of the aerosol-generating device is electrically disconnected from the first electrical connector part 313 by pivoting the device holder from the closed position to the open position, which moves the distal end face of the aerosol-generating device relative to the housing 302 and the first electrical connector part 313.

Figure 13:
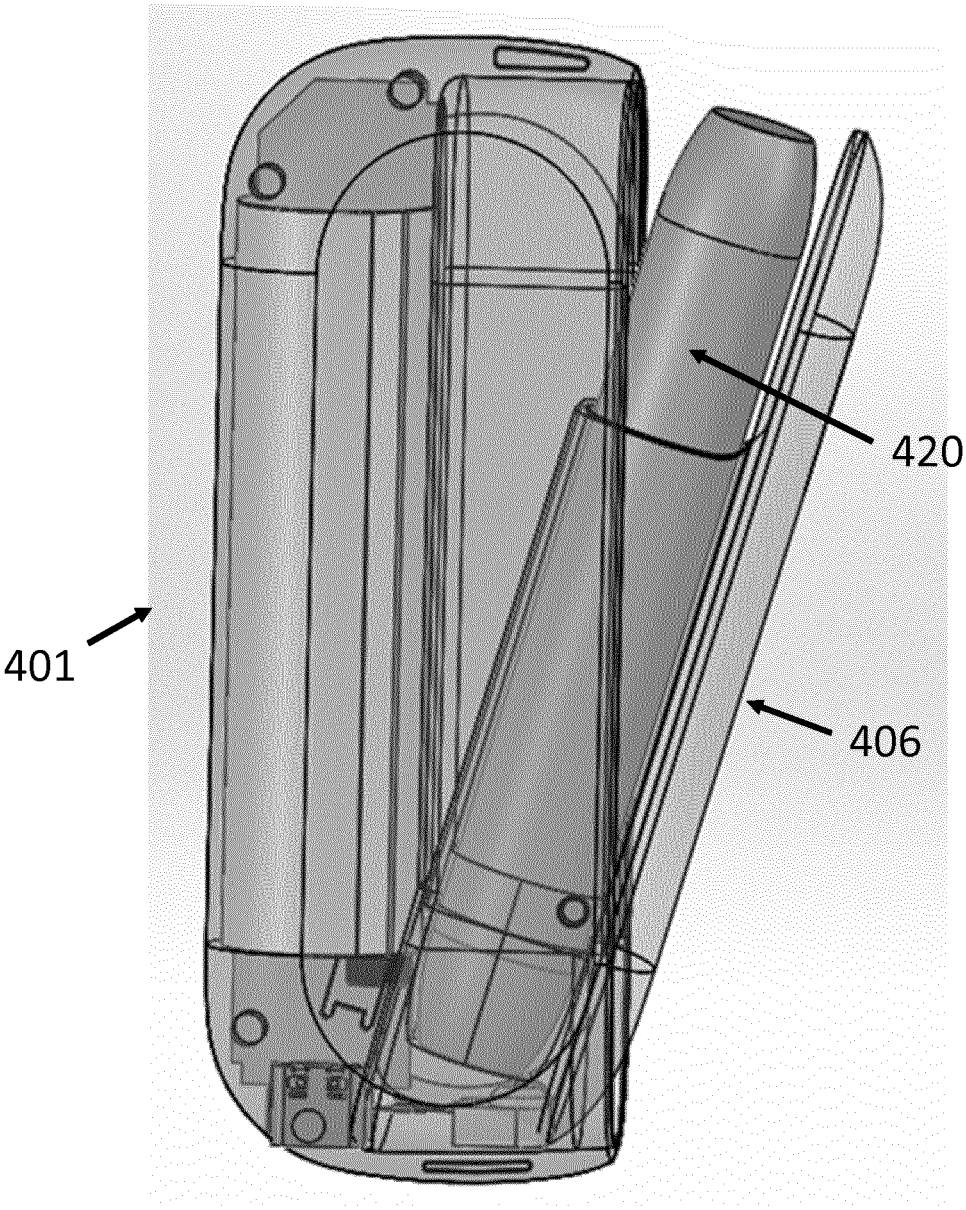
FIG. 13 shows a schematic illustration of a case according to another embodiment of the present invention, with the device holder in an open position and an aerosol-generating device received in the device holder.

FIG. 13 shows an electrically operated aerosol-generating system according to another embodiment of the present invention. The case 401 of FIG. 13 is substantially similar to the case 201 according to the embodiment shown in FIG. 11, described above. However, the case 401 has a second electrical connector part (not shown) at the closed end of the device holder 406 that is permanently electrically connected to the electrical circuitry (not shown) of the case 401 by a flexible printed circuit (not shown). As shown in FIG. 13, the case 401 includes a housing having rounded edges to provide a shape that is easy and comfortable for a user to hold. The case 401 comprises a device holder 406 that is pivotally coupled to the housing at a position near to a first end of the device holder 406. The device holder 406 comprises an external wall that forms a sidewall of the housing when the device holder is in the close position and an internal wall that forms a substantially circularly cylindrical tube having a circularly cylindrical passage with two opposing open ends. The external wall of the device holder 406 extends substantially the length of the housing, whereas the internal wall extends from around the first end of the device housing about 70% of the length of the external wall. This arrangement of the internal wall provides a gap between the internal wall and the external wall at the second end of the device holder 406. This gap at the second end of the device holder 406 is exposed when the device holder is in the open position, as shown in FIG. 13. The gap enables a user to insert a distal end of an aerosol-generating device into the device holder from a wide ranges of angles, which makes insertion of an aerosol-generating device into the holder straightforward for a user. The gap also enables a user to grip an aerosol-generating device received in the device holder when the device holder is in the open position.

It will be appreciated that the above described embodiments are exemplary embodiments of the invention only. It will also be appreciated that features described above in relation to one embodiment may also be applied to other embodiments of the invention.

The invention claimed is:

1. An electrically operated aerosol-generating system, comprising:

an aerosol-generating device comprising:

a proximal end, a distal end opposite the proximal end, the distal end having a distal end face, a first rechargeable electrical power supply, and a cavity configured to receive an aerosol-forming substrate at the proximal end; and a case configured to receive the aerosol-generating device, the case comprising:

a housing having an opening, and a device holder pivotally coupled to the housing and pivotable relative to the housing between an open position and a closed position, the device holder comprising an external wall and one or more internal walls arranged to releasably hold the aerosol-generating device, and a second rechargeable electrical power supply housed in the housing and configured to supply power to the aerosol-generating device, wherein:

the device holder has a first end and a second end, opposite the first end, the device holder being pivotally coupled to the housing at or around the first end, the system further comprises an electrical connector comprising:

a first connector part at the distal end face of the aerosol-generating device, and a second connector part in the housing or the device holder of the case at or around the first end of the device holder, and the first and the second connector parts being arranged to electrically connect when the aerosol-generating device is received in the device holder.

2. The electrically operated aerosol-generating system according to claim 1, wherein a portion of the device holder at or around the second end does not comprise the one or more internal walls.

3. The electrically operated aerosol-generating system according to claim 1, wherein the external wall of the device holder is arranged to cover the opening of the housing when the device holder is in the closed position.

4. The electrically operated aerosol-generating system according to claim 1, wherein the external wall of the device holder has a length and the one or more internal walls of the device holder have a length, and the length of the one or more internal walls is less than the length of the external wall.

5. The electrically operated aerosol-generating system according to claim 1, wherein the length of the one or more internal walls of the device holder is no more than 75% of the length of the external wall of the holder.

6. The electrically operated aerosol-generating system according to claim 1, wherein the one or more internal walls of the device holder substantially extend along the external wall of the device holder from at or around the first end of the device holder in a direction towards the second end of the device holder.

7. The electrically operated aerosol-generating system according to claim 1, wherein the one or more internal walls of the device holder are configured to be received in the housing when the device holder is in the closed position such that when the aerosol-generating device is releasably held in the device holder the aerosol-generating device is received in the housing when the device holder is in the closed position.

8. The electrically operated aerosol-generating system according to claim 7, wherein the housing and the external wall of the device holder are arranged to substantially enclose the aerosol-generating device when the aerosol-generating device is received in the device holder and the device holder is in the closed position.

9. The electrically operated aerosol-generating system according to claim 1, wherein the opening of the housing extends substantially over one side of the housing.

10. The electrically operated aerosol-generating system according to claim 1, wherein the external wall and the one or more internal walls of the device holder are arranged to form a passage configured to receive the aerosol-generating device.

11. The electrically operated aerosol-generating system according to claim 10, wherein the passage has a closed end at the first end of the device holder, the closed end defining a closed end face and the second connector part being arranged at the closed end face.

12. The electrically operated aerosol-generating system according to claim 10, wherein the passage has an open end at the first end of the device holder and the second connector part is arranged at the housing of the case around the first end of the device holder when the device holder is in the closed position.

13. The electrically operated aerosol-generating system according to claim 1, wherein the system further comprises magnetic retention means for releasably retaining the first and the second connector parts in electrical engagement, the magnetic retention means comprising a first magnetic material provided on the aerosol-generating device and a second magnetic material provided on the case.

14. The electrically operated aerosol-generating system according to claim 13, wherein the first magnetic material is arranged at the first connector part and the second magnetic material is arranged at the second connector part.

15. The electrically operated aerosol-generating system according to claim 1, wherein the case further comprises means for releasably retaining the housing and the device holder in the closed position.

* * * * *